US011603606B2

(12) United States Patent
Hyakutake et al.

(10) Patent No.: US 11,603,606 B2
(45) Date of Patent: Mar. 14, 2023

(54) THERMO-FUSIBLE CONJUGATE FIBERS AND METHOD FOR PRODUCING SAME, AND NONWOVEN FABRIC USING SAME

(71) Applicants: ES FiberVisions Co., Ltd., Osaka (JP); ES FiberVisions Hong Kong Limited, Kowloon (HK); ES FiberVisions LP, Athens, GA (US); ES FiberVisions ApS, Varde (DK)

(72) Inventors: Takahiro Hyakutake, Osaka (JP); Shinei Gima, Osaka (JP)

(73) Assignees: ES FiberVisions Co., Ltd., Osaka (JP); ES FiberVisions Hong Kong Limited, Kowloon (HK); ES FiberVisions LP, Athens, GA (US); ES FiberVisions ApS, Varde (DK)

( * ) Notice: Subject to any disclaimer, the term of this patent is extended or adjusted under 35 U.S.C. 154(b) by 209 days.

(21) Appl. No.: 16/305,394

(22) PCT Filed: May 25, 2017

(86) PCT No.: PCT/JP2017/019580
§ 371 (c)(1),
(2) Date: Nov. 29, 2018

(87) PCT Pub. No.: WO2017/208967
PCT Pub. Date: Dec. 7, 2017

(65) Prior Publication Data

US 2020/0318259 A1 Oct. 8, 2020

(30) Foreign Application Priority Data

May 30, 2016 (JP) ..... JP2016-107259

(51) Int. Cl.

| | |
|---|---|
| ***D01F 8/14*** | (2006.01) |
| ***D04H 1/541*** | (2012.01) |
| ***D01D 5/34*** | (2006.01) |
| ***D01F 8/06*** | (2006.01) |
| ***D04H 1/544*** | (2012.01) |
| ***D04H 1/55*** | (2012.01) |

(52) U.S. Cl.
CPC ..... *D01F 8/14* (2013.01); *D01D 5/34* (2013.01); *D01F 8/06* (2013.01); *D04H 1/544* (2013.01); *D04H 1/5412* (2020.05); *D04H 1/55* (2013.01)

(58) Field of Classification Search
USPC ..... 428/373, 375; 264/29.2; 423/447.4; 524/8, 47, 445
See application file for complete search history.

(56) References Cited

U.S. PATENT DOCUMENTS

| | | | | |
|---|---|---|---|---|
| 8,147,956 | B2 * | 4/2012 | Miyauchi ..... | D04H 1/4382 428/373 |
| 2009/0029165 | A1 | 1/2009 | Goda | |
| 2012/0114940 | A1 | 5/2012 | Kamada et al. | |
| 2012/0184168 | A1 | 7/2012 | Suzuki et al. | |
| 2016/0115630 | A1 | 4/2016 | Kubota et al. | |

FOREIGN PATENT DOCUMENTS

| | | |
|---|---|---|
| CN | 105283589 | 1/2016 |
| JP | S63135549 | 6/1988 |
| JP | H08246246 | 9/1996 |
| JP | H11256465 | 9/1999 |
| JP | 2009013544 | 1/2009 |
| JP | 2009114613 | 5/2009 |
| JP | 2013119689 | 6/2013 |
| WO | 2008133348 | 11/2008 |
| WO | 2009051283 | 4/2009 |
| WO | 2014192976 | 12/2014 |

OTHER PUBLICATIONS

Office Action of Taiwan Counterpart Application, with English translation thereof, dated Jul. 24, 2020, pp. 1-19.
"International Search Report (Form PCT/ISA/210) of PCT/JP2017/019580," dated Jul. 4, 2017, pp. 1-2.
"Written Opinion of the International Searching Authority (Form PCT/ISA/237) of PCT/JP2017/019580," dated Jul. 4, 2017, pp. 1-3.
"Search Report of Europe Counterpart Application", dated Nov. 4, 2019, p. 1-p. 6.
"Office Action of China Counterpart Application", dated Dec. 9, 2020, with English translation thereof, pp. 1-15.
"Office Action of Taiwan Counterpart Application" with English translation thereof, dated Mar. 19, 2021, p. 1-p. 26.
"Office Action of Korea Counterpart Application" with English translation thereof, dated May 28, 2021, p. 1-p. 13.

* cited by examiner

*Primary Examiner* — Lynda Salvatore
(74) *Attorney, Agent, or Firm* — JCIPRNET

(57) ABSTRACT

Shown are thermo-fusible conjugate fibers having a high degree of crystallinity, while a degree of orientation is suppressed, and a bulky and soft nonwoven fabric using the same. The thermo-fusible conjugate fibers have, as a first component, a polyester-based resin, and as a second component, an olefin-based resin having a melting point lower than a melting point of the first component, in which the degree of orientation in the polyester-based resin is 6.0 or less, and the degree of crystallinity therein is 20% or more. The conjugate fibers are preferably sheath-core conjugate fibers in which the first component is a core component and the second component is a sheath component.

8 Claims, No Drawings

THERMO-FUSIBLE CONJUGATE FIBERS AND METHOD FOR PRODUCING SAME, AND NONWOVEN FABRIC USING SAME

CROSS-REFERENCE TO RELATED APPLICATION

This application is a 371 application of the international PCT application serial no. PCT/JP2017/019580, filed on May 25, 2017, which claims the priority benefit of Japan application no. 2016-107259, filed on May 30, 2016. The entirety of each of the above-mentioned patent applications is hereby incorporated by reference herein and made a part of this specification.

TECHNICAL FIELD

The invention relates to thermo-fusible conjugate fibers. More specifically, the invention relates to thermo-fusible conjugate fibers in which a core component has a degree of orientation and a degree of crystallinity in a specific range.

BACKGROUND ART

Thermo-fusible conjugate fibers that can be formed by thermal fusion by utilizing hot air or heat energy of a heat roll have so far been widely used for a hygienic material such as a diaper, a napkin and a pad, an industrial material such as consumer goods and a filter, or the like because a nonwoven fabric that is excellent in bulkiness and flexibility can be easily obtained. In particular, in the hygienic material, a level of importance of the bulkiness and the flexibility is significantly high because of a material in direct contact with a human skin and a need of quickly absorbing a liquid such as urine and menstrual blood. In order to obtain the bulkiness, a technique of using a high stiffness resin and a technique of giving stiffness by stretching at a high ratio are typical, but in such a case, the flexibility is reduced in a nonwoven fabric obtained. On the other hand, if the flexibility takes precedence, the bulkiness is reduced and liquid absorbance is deteriorated in the nonwoven fabric obtained.

Therefore, proposals have been made on many methods for obtaining fibers and a nonwoven fabric in which both the bulkiness and the flexibility can be satisfied. For example, a method for producing a bulky nonwoven fabric by using sheath-core conjugate fibers is disclosed in which high isotacticity polypropylene is applied as a core component and a resin mainly composed of polyethylene is applied as a sheath component (see Patent literature No. 1). The method provides the resulting nonwoven fabric with bulkiness by using a high stiffness resin on a side of a core of conjugate fibers, in which the nonwoven fabric is not sufficient in the flexibility, and particularly if a thermobonding temperature is increased, the bulkiness of the resulting nonwoven fabric is also reduced, and therefore satisfaction of both has been difficult.

Moreover, in Patent literature No. 2, a three-dimensional entangling processing is applied to a fiber web containing splittable conjugate fibers, and the splittable conjugate fibers are split into ultra-fine fibers to obtain flexibility. A bulky nonwoven fabric is obtained by creating an uneven surface of a nonwoven fabric. According to the method, although flexibility and bulkiness are obtained, if splittability is deteriorated, split fibers are not formed into ultra-fine fibers to cause a problem of reduction of flexibility, and the method has been insufficient in stability.

Moreover, Patent literature No. 3 discloses that a flow-stretching process can be easily and stably developed in thermo-fusible conjugate fibers having, as a first component (core), a polyester-based polymer, and as a second component (sheath), an olefin-based polymer a melting point of which is lower than a melting point of the first component, in which birefringence of polyester being the first component is 0.150 or less and a birefringence ratio of the first component to the second component is 3.0 or less. The invention in Patent literature No. 3 discloses that thermo-fusible fibers having small fineness can be stably produced, and describes that the thermo-fusible fibers may be preferably used in a hygienic material application and an industrial material application. However, even in the thermo-fusible conjugate fibers produced through the flow-stretching process as in the invention in Patent literature No. 3, the flexibility and the bulkiness when there fibers are formed into a nonwoven fabric have been not necessarily satisfactory.

CITATION LIST

Patent Literature

Patent literature No. 1: JP S63-135549 A.
Patent literature No. 2: JP 2009-13544 A.
Patent literature No. 3: JP 2009-114613 A.

SUMMARY OF INVENTION

Technical Problem

The invention is contemplated for providing thermo-fusible conjugate fibers that provide a nonwoven fabric with both flexibility and bulkiness, and a nonwoven fabric using the same.

Solution to Problem

The present inventors have diligently continued to conduct research in order to solve the problem described above, and as a result, have focused attention on a state of molecules in a core component, and have found that the problem can be solved by forming thermo-fusible conjugate fibers having a high degree of crystallinity in the core component, while a degree of orientation is suppressed, and thus have completed the invention.

More specifically, the invention has a structure described below.

Item 1. Thermo-fusible conjugate fibers in which a first component is a polyester-based resin, and a second component is an olefin-based resin having a melting point lower than a melting point of the first component, wherein a degree of orientation in the polyester-based resin is 6.0 or less and a degree of crystallinity is 20% or more therein.

Item 2. The thermo-fusible conjugate fibers according to item 1, being sheath-core conjugate fibers in which the first component is a core component and the second component is a sheath component.

Item 3. The thermo-fusible conjugate fibers according to item 1 or 2, wherein, in DSC measurement, a peak ratio (peak 1/peak 2) with regard to a peak height (peak 1) of a maximum endothermic peak of an endothermic peak in the range of 245° C. to 250° C. to a peak height (peak 2) of a maximum endothermic peak of an endothermic peak in the range of 251° C. to 256° C. is 2.2 or more.

Item 4. The thenno-fusible conjugate fibers according to any one of items 1 to 3, wherein single yarn fiber strength is 3.2 cN/dtex or less.

Item 5. The thermo-fusible conjugate fibers according to any one of items 1 to 4, wherein single yarn fiber elongation is 100% or more.

Item 6. A sheet-shaped fiber aggregate, containing the thermo-fusible conjugate fibers according to any one of items 1 to 5.

Item 7. The sheet-shaped fiber aggregate according to item 6, being a nonwoven fabric.

Item 8. A method for producing thenrmo-fusible conjugate fibers, including:

(1) a step of obtaining unstretched sheath-core conjugate fibers by melt spinning by applying, as a core component, a polyester-based resin, and as a sheath component, an olefin-based resin having a melting point lower than a melting point of the polyester-based resin; and (2) a step of stretching the unstretched sheath-core conjugate fibers obtained in the step (1) at a temperature higher by 30° C. or more than a glass transition temperature of the polyester-based resin.

Item 9. A method for producing a nonwoven fabric, including:

(1) a step of obtaining unstretched sheath-core conjugate fibers by melt spinning by applying, as a core component, a polyester-based resin, and as a sheath component, an olefin-based resin having a melting point lower than a melting point of the polyester-based resin;

(2) a step of stretching the unstretched sheath-core conjugate fibers obtained in the step (1) at a temperature higher by 30° C. or more than a glass transition temperature of the polyester-based resin;

(3) a step of forming a fiber web by a carding method using the thermo-fusible conjugate fibers being the sheath-core conjugate fibers obtained in the step (2); and (4) a step of bonding entanglement parts of the fiber web by applying heat treatment to the fiber web obtained in the step (3) at a temperature equal to or higher than the melting point of the olefin-based resin and lower than the melting point of the polyester-based resin.

Advantageous Effects of Invention

Thermo-fusible conjugate fibers of the invention have features in which a degree of orientation in a core component is low and a degree of crystallinity therein is high, and the thermo-fusible conjugate fibers having a structure of the invention can provide a nonwoven fabric with both flexibility and bulkiness. Moreover, according to the production method of the invention, the thermo-fusible conjugate fibers having the structure described above or the nonwoven fabric can be stably provided.

DESCRIPTION OF EMBODIMENTS

The invention will be described in more detail below.

Thermo-fusible conjugate fibers of the invention are configured by disposing a polyester-based resin as a first component and an olefin-based resin as a second component a melting point of which is lower than a melting point of the first component.

(First Component)

The polyester-based resin that constitutes the first component of the thermo-fusible conjugate fibers (hereinafter, simply referred to as "conjugate fibers" in several cases) of the invention can be obtained by polycondensation from diol and dicarboxylic acid. Specific examples of the dicarboxylic acid used for polycondensation of the polyester-based resin include terephthalic acid, isophthalic acid, 2,6-naphthalenedicarboxylic acid, adipic acid and sebacic acid. Moreover, specific examples of the diol used include ethylene glycol, diethylene glycol, 1,3-propanediol, 1,4-butanediol, neopentyl glycol and 1,4-cyclohexanedimethanol.

As the polyester-based resin to be used in the invention, aromatic polyester such as polyethylene terephthalate, polypropylene terephthalate and polybutylene terephthalate can be preferably used. Moreover, aliphatic polyester can also be used in addition to the aromatic polyester, and specific examples of a preferred aliphatic polyester resin include polylactic acid and polybutylene succinate. The polyester-based resins may be not only a homopolymer but also a copolymerized polyester (copolyester). On the above occasion, as a copolymerization component, a dicarboxylic acid component such as adipic acid, sebacic acid, phthalic acid, isophthalic acid and 2,6-naphthalene dicarboxylic acid, a diol component such as diethylene glycol and neopentyl glycol, and an optical isomer such as L-lactic acid can be utilized. Specific examples of such a copolymer include polybutylene adipate terephthalate. Further, two or more kinds of the polyester-based resins may be mixed and used.

If a raw material cost, thermal stability of the fibers obtained and so forth are taken into consideration, as the first component, an unmodified polymer formed only of polyethylene terephthalate is most preferred.

The first component is not particularly limited as long as the polyester-based resin is contained therein, but the polyester-based resin is contained in an amount of preferably 80% by mass or more, and further preferably 90% by mass or more. An additive such as an antioxidant, a light stabilizer, an ultraviolet light absorber, a neutralizer, a nucleating agent, an epoxy stabilizer, a slipping agent, an antibacterial agent, a flame retardant, an antistatic agent, a pigment and a plasticizer may be further appropriately added, when necessary, within the range in which advantageous effects of the invention are not adversely affected.

(Second Component)

The polyolefin-based resin that constitutes the second component of the conjugate fibers of the invention is not particularly limited as long as conditions of having the melting point lower than the melting point of the polyester-based resin that constitutes the first component are satisfied. For example, polyethylene, polypropylene, polybutene-1, polyhexene-1, polyoctene-1, poly(4-methylpentene-1), poly-methylpentene, 1,2-polybutadiene, 1,4-polybutadiene or the like can be used. Further, in the above homopolymers, a small amount of α-olefin such as ethylene, propylene, butene-1, hexene-1, octene-1 and 4-methylpentene-1 may be contained as a copolymer component under conditions of being a component other than a monomer that constitutes the homopolymer. Moreover, a small amount of other ethylenic unsaturated monomers such as butadiene, isoprene, 1,3-pentadiene, styrene and α-methylstyrene may be contained as the copolymer component.

Moreover, two or more kinds of the polyolefin-based resins may be mixed and used. As the resins, not only a polyolefin-based resin polymerized using an ordinary Ziegler-Natta catalyst but also a polyolefin-based resin polymerized using a metallocene catalyst, and a copolymer thereof can be preferably used. Moreover, a melt mass flow rate (hereinafter, abbreviated as MFR) of the polyolefin-based resin that can be preferably used is not particularly limited in the range in which spinning can be performed, but is preferably 1 to 100 g/10 min, and further preferably 5 to 70 g/10 min.

The polyolefin-based resin that constitutes the second component of the conjugate fibers of the invention is preferably at least one kind of polyolefin-based resin selected from the group of polyethylene, polypropylene and a copolymer containing propylene as a main component. Specific examples thereof include high density polyethylene, linear low density polyethylene, low density polyethylene, polypropylene (propylene homopolymer), an ethylene-propylene copolymer containing propylene as a main component and an ethylene-propylene-butene-1 copolymer containing propylene as a main component. Here, a term "copolymer containing propylene as a main component" means a copolymer in which a propylene unit is contained in a largest amount in the copolymer component that constitutes the copolymer.

Physical properties of polyolefin, other than the MFR described above, for example, physical properties such as a Q value (weight average molecular weight/number average molecular weight), Rockwell hardness and the number of branched methyl chains are not particularly limited as long as the physical properties meet the requirement according to the invention. The second component is not particularly limited as long as the polyolefin-based resin is contained therein, but the polyolefin-based resin is contained in an amount of preferably 80% by mass or more, and further preferably 90% by mass or more. The additive exemplified in the first component may be appropriately contained therein, when necessary, within the range in which advantageous effects of the invention are not adversely affected.

(Conjugate Fibers)

The conjugate fibers of the invention are preferably the sheath-core conjugate fibers having, as the core component, the first component, and as the sheath component, the second component. A combination of the first component and the second component in the conjugate fibers of the invention is not particularly limited as long as conditions are satisfied in which the polyolefin-based resin that constitutes the second component has the melting point lower than the melting point of the polyester-based resin that constitutes the first component, and can be used by selection from the first component and the second component described above. Specific examples of the combination of the first component and the second component include a combination of polyethylene terephthalate and polypropylene, a combination of polyethylene terephthalate and high density polyethylene, a combination of polyethylene terephthalate and linear low density polyethylene and a combination of polyethylene terephthalate and low density polyethylene. A further preferred combination among the combinations is a combination of polyethylene terephthalate and high density polyethylene.

A conjugation form of the conjugate fibers is not particularly limited as long as the first component is arranged inside the fibers as the core component and the second component is arranged outside the fibers as the sheath component, but is preferably a conjugation form in which the second component completely covers a fiber surface, and above all, a concentric or eccentric sheath-core structure is particularly preferred. As a cross-sectional shape of the fibers, any of a round shape such as a circle and an ellipse, an angular shape such as a triangle and a square, an irregular shape such as a star shape and a double quatrefoil shape, a hollow shape or the like can be applied.

A component ratio upon conjugating the first component and the second component is not particularly limited, but the first component/the second component is preferably 10/90 to 70/30 (volume ratio), and further preferably 30/70 to 60/40 (volume ratio). Adjustment of the component ratio to such a range provides the nonwoven fabric with the bulkiness and the flexibility, and has tendency of being excellent in a balance with processability into the nonwoven fabric, and therefore is preferred.

Fineness of the conjugate fibers of the invention is not particularly limited, but is preferably 0.9 to 8.0 dtex, and specifically preferably 1.0 to 6.0 dtex, and further preferably 1.3 to 4.4 dtex with regard to the fibers used in hygienic material. Adjustment of the fineness to such a range facilities satisfaction of both the bulkiness and the flexibility.

In the conjugate fibers of the invention, a degree of orientation of the polyester-based resin being the first component (core component) is 6.0 or less, and preferably 3.0 to 6.0. Adjustment of the degree of orientation to such a range can provide the nonwoven fabric with the flexibility. The degree of orientation is preferably lower, and if the degree of orientation is over 6.0, the flexibility becomes insufficient. Moreover, a degree of crystallinity of the polyester-based resin is 20% or more, and preferably 20 to 30%. Adjustment of the degree of crystallinity to such a range can provide the nonwoven fabric with the bulkiness. The degree of crystallinity is preferably higher, and if the degree of crystallinity is less than 20%, sufficient bulkiness is hardly obtained. The invention has been found that the degree of orientation and the degree of crystallinity in the core component of the thermo-fusible conjugate fibers have a decisive influence on physical properties of a nonwoven fabric, and provides a nonwoven fabric having both the flexibility and bulkiness by allowing the degree of orientation and the degree of crystallinity to be in the range described above.

The degree of orientation and the degree of crystallinity in the core component of the conjugate fibers specified in the invention can be measured according to a publicly known method. For example, the degree of orientation can be obtained by a method such as a birefringence, an X-ray diffraction and laser Raman spectroscopy. For example, the degree of crystallinity can be obtained by the birefringence, the X ray diffraction and the laser Raman spectroscopy. In particular, "a degree of orientation is 6.0 or less" in the invention means that a value obtained according to measurement of a degree of orientation based on the laser Raman spectroscopy is 6.0 or less as described in Examples later in detail. Moreover, "a degree of crystallinity is 20% or more" in the invention means that a value obtained according to measurement of a degree of crystallinity based on the laser Raman spectroscopy is 20% or more as described in Examples below in detail.

In the conjugate fibers of the invention, in DSC measurement, a peak ratio (peak 1/peak 2) with regard to a peak height (peak 1) of a maximum endothermic peak in an endothermic peak in the range of 245° C. to 250° C. to a peak height (peak 2) of a maximum endothermic peak in an endothermic peak in the range of 251° C. to 256° C. is preferably 2.2 or more, and further preferably 2.2 to 8.0. The peak ratio specified in the invention is considered to be a value reflecting the degree of crystallinity of the core component of the conjugate fibers, and use of the peak ratio in the above range can allow the fibers to have stiffness and the bulkiness.

Single yarn fiber elongation of the conjugate fibers of the invention is preferably 100% or more, and further preferably 100 to 200%. Use of the conjugate fibers with the elongation in the above range can allow a nonwoven fabric to have the flexibility.

Single yarn fiber strength of the conjugate fibers of the invention is not particularly limited, but in fibers used for a hygienic material for example, is preferably 1.0 to 4.0 cN/dtex, and further preferably 2.0 to 3.2 cN/dtex. Use of the strength in the above range can allow the fibers to have both form stability and the bulkiness.

(Method for Producing Conjugate Fibers)

A method for producing conjugate fibers of the invention will be described.

The conjugate fibers can be produced as described below, for example. First, a polyester-based resin used as a raw material of the conjugate fibers of the invention is arranged as the first component, and an olefin-based resin having a lower melting point than a melting point of the first component is arranged as the second component to prepare unstretched fibers in which the first component and the second component are conjugated in a concentric and sheath-core type by melt spinning.

Temperature conditions during melt spinning are not particularly limited, but spinning temperature is preferably 250° C. or higher, further preferably 280° C. or higher, and still further preferably 300° C. or higher. If the spinning temperature is 250° C. or higher, the number of times of fiber breakage during spinning can be reduced, and an unstretched fiber in which elongation after stretching easily remains can be obtained, and therefore such a case is preferred. If the spinning temperature is 280° C. or higher, the above effects become further significant, and if the spinning temperature is 300° C. or higher, the effects become still further significant, and therefore such cases are preferred. An upper limit of the temperature is not particularly limited as long as a temperature at which spinning can be preferably performed is applied.

Moreover, a spinning speed is not particularly limited, but is preferably 300 to 1500 m/min, and further preferably 400 to 1000 m/min. If the spinning speed is 300 m/min or more, a single-hole output upon obtaining unstretched fibers is increased, and satisfactory productivity can be obtained, and therefore such a case is preferred.

The unstretched fibers obtained under the conditions described above are subjected to stretching processing in a stretching step. Stretching temperature is a temperature higher by 30 to 70° C. than a glass transition temperature of the polyester-based resin that constitutes the first component and lower than a melting point of the polyolefin-based resin that constitutes the second component, and is preferably higher by 30 to 60° C. than the glass transition temperature of the polyester-based resin and lower than the melting point of the polyolefin-based resin.

Here, the stretching temperature means a temperature of the fibers in a stretching start position. If the stretching temperature is equal to or higher than a level "the glass transition temperature of the polyester-based resin being the first component+30° C.," the effects can be obtained even when the fibers are stretched at a high strain rate, more specifically, at a high ratio, and therefore such a case is preferred. Moreover, the stretching temperature is required to be adjusted to a level lower than the melting point of the olefin-based resin being the second component to suppress destabilization by fusion of the fibers with each other in a stretching process. For example, in a case of stretching the unstretched fibers prepared by disposing, as the first component, polyethylene terephthalate a glass transition temperature of which is 70° C., and as the second component, high density polyethylene having a melting point of 130° C., a stretching temperature of 100° C. or higher and lower than 130° C. is applied. If the stretching temperature is 100° C. or higher, an amount of heat to the fibers is increased, and a difference in stretchability between polyethylene terephthalate and the high density polyethylene is reduced. Thus, a risk of causing sheath-core peeling is reduced during carding processing in a step of forming the nonwoven fabric.

A stretch ratio is 75 to 95% of a stretch ratio at break in the unstretched fibers, preferably 80 to 95% thereof, and further preferably in the range of 85 to 90% thereof. In addition, the stretch ratio at break means a stretch ratio upon causing break in the fibers, when the unstretched fibers are stretched.

Next, stretched fibers obtained in the stretching step are mechanically crimped, and then dried by heat treatment to progress crystallization. As a drying temperature, drying is preferably performed in a temperature range that is lower than the melting point of the second component, but is not lower by over 15° C.

Upon processing the conjugate fibers of the invention into the nonwoven fabric, when a carding step is adopted, the fibers are required to be cut into an arbitrary length in order to pass the fibers through a carding machine. A length at which the fibers are cut, namely a cut length can be selected from the range of 15 to 125 mm, in taking into account the fineness and performance of passing through the carding machine, and is preferably 30 to 75 mm.

In order to process the conjugate fibers of the invention into the nonwoven fabric, a technique is preferably applied in which the fiber web is formed, and then heat treatment is applied thereto to form the nonwoven fabric by causing thermal fusion of entangled points of the fibers that constitute the fiber web. A method of forming the fiber web includes a carding method of passing the fibers cut into a predetermined length as described above through the carding machine, and in order to form a bulky fiber web, the carding method is preferably applied.

Specific examples of a publicly-known method of applying heat treatment to the fiber web formed by the carding method include a method such as a hot-air bonding method and a heat-roll bonding method, and a hot-air bonding method is preferred as a heat treatment method to be applied after the conjugate fibers of the invention are formed into the fiber web. The hot-air bonding method is a method in which heated air or steam is wholly or partially passed through the fiber web to soften and melt a low-melting point component in the conjugate fibers that constitute the fiber web to bond entanglement parts of the fibers, and is not a method in which a predetermined area is pressed to adversely affect the bulkiness as in the heat-roll bonding method, and therefore is a heat treatment method that is suitable for providing a bulky nonwoven fabric with good texture as an object of the invention.

Examples

Examples described below are merely for illustrative purposes only. A scope of the invention is not limited to the present Examples.

In addition, an evaluation of physical properties in the invention was performed according to a method described below.

(Measurement of a Melt Mass Flow Rate (MFR))

A melt mass flow rate was measured in accordance with JIS K 7210. Here, MI was measured in accordance with conditions D (test temperature: 190° C., load: 2.16 kg) in Table 1, in appendix A, and MFR was measured in accordance with conditions M (test temperature: 230° C., load: 2.16 kg).

(Degree of Orientation)

Measurement was performed using Laser Raman microscope made by Nanophoton Corporation. A degree of orientation of fibers was determined from the formula described below, when (benzene ring C═C stretching band) peak intensity near 1615 $cm^{-1}$ of a Raman spectrum obtained by detecting Raman scattering light polarized in a length direction of fibers by irradiating the fibers with laser light polarized in the length direction of the fibers was taken as Iyy, and peak intensity of the 1615 $cm^{-1}$ band of the Raman spectrum obtained by detecting the Raman scattering light polarized in a diameter direction of the fibers by irradiating the fibers with laser light polarized in the diameter direction of the fibers was taken as Ixx.

$$\text{Degree of orientation}=Iyy/Ixx$$

(Degree of Crystallinity)

Calculation was performed from the formula described below by using Laser Raman microscope made by Nanophoton Corporation.

$$\text{Reduced density } \rho\ (g/cm^3)=(305-\Delta\nu_{1730})/209$$

$$\text{Degree of crystallinity } \chi\ (\%)=100\times(\rho-1.335)/(1.455-1.335)$$

In addition, $\Delta\nu_{1730}$ is a full width at half maximum of a Raman band (C═O stretching band) near 1730 ($cm^{-1}$).

(DSC)

Measurement was performed using DSC "Q-10" made by TA Instruments Inc. Fibers were cut to be 4.20 to 4.80 mg in mass, and cut fibers were packed in a sample pan, and a cover was placed thereon. Measurement was performed at a heating rate of 10° C./min from 30° C. to 300° C. in $N_2$ purging, and a melting chart was obtained. The chart was analyzed, and a peak ratio (peak 1/peak 2) with regard to a peak height (peak 1) of a maximum endothermic peak in an endothermic peak in the range of 245° C. to 250° C. to a peak height (peak 2) of a maximum endothermic peak in an endothermic peak in the range of 251° C. to 256° C. was determined.

(Single Fiber Strength and Elongation)

Measurement was performed on stretched fibers in accordance with JIS L 1015.

(Flexibility)

A sample nonwoven fabric was cut into 150 mm×150 mm, and judgement was made from sensory testing by five panelists from a viewpoint of surface smoothness, cushioning properties, drape properties or the like. Evaluation results thereof were classified as described below, and evaluation was made based on the criteria in three stages described below.

Good: felt to be "satisfactory" by all the five panelists

Marginal: felt to be "unsatisfactory" by one to two panelists

Poor: felt to be "unsatisfactory" by three or more panelists (Specific Volume (Bulkiness))

A thickness of a nonwoven fabric was measured in a state of applying a load of 3.5 $g/cm^2$ by using Digimatic Indicator (made by Mitutoyo Corporation). A specific volume was calculated from the measured thickness by using a numerical expression described below.

$$\text{Specific volume } (cm^3/g) \text{ of nonwoven fabric}=\text{thickness (mm) of nonwoven fabric/basis weight } (m^2/g) \text{ of nonwoven fabric}\times 1000$$

Evaluation was made on the bulkiness from a value of the specific volume obtained, and classification was made as described below, and the evaluation was made based on the criteria in three stages described below.

Good: 70 $cm^3/g$ or more in specific volume.

Marginal: 60 to 69 $cm^3/g$ in specific volume

Poor: less than 60 $cm^3/g$ in specific volume

Thermo-fusible conjugate fibers and nonwoven fabrics in Examples and Comparative Examples were produced by using materials under conditions as shown in Table 1 described below.

(Thermoplastic Resin)

Resins described below were used as thermoplastic resins that constitute the conjugate fibers.

First component: polyethylene terephthalate (abbreviation: PET) in which intrinsic viscosity is 0.64, and a glass transition temperature is 70° C.

Second component: high density polyethylene (abbreviation: PE) in which density is 0.96 $g/cm^3$, MFR (190° C., load: 21.18 N) is 16 g/10 min, and a melting point is 130° C.

(Production of Thermo-Fusible Conjugate Fibers)

Spinning was made by using a thermoplastic resin shown in Table 1, and disposing a first component on a core side, and a second component on a sheath side at an extrusion temperature and a conjugation ratio (volume ratio) as shown in Table 1.

The resulting unstretched fibers were subjected to a stretching step under conditions shown in Table 1 by using a stretch machine and setting a stretching temperature to 90 to 125° C. Then, thermo-fusible conjugate fibers were obtained by applying a drying step (heat treatment step) for 5 minutes at a drying temperature (heat treatment temperature) shown in Table 1.

(Processing into Nonwoven Fabric)

The thermo-fusible conjugate fibers were fed to a roller carding machine to collect a fiber web, a sample having a dimension of 100 cm×30 cm was cut from the fiber web, and heat treatment was applied to the sample by using a heat treatment machine of a hot-air circulation type at a processing temperature of 130° C. to thermally fuse a sheath component into a nonwoven fabric having a basis weight of about 25 $g/m^2$.

Production conditions and results of evaluating physical properties in each Example and each Comparative Example were collectively shown in Table 1.

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| First component | PET | PET | PET | PET | PET | PET | PET | PET |
| Intrinsic viscosity (η) | 0.64 | 0.64 | 0.64 | 0.64 | 0.64 | 0.64 | 0.64 | 0.64 |

TABLE 1-continued

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Glass transition temperature (° C.) | 70 | 70 | 70 | 70 | 70 | 70 | 70 | 70 |
| Melting point (° C.) | 255 | 255 | 255 | 255 | 255 | 255 | 255 | 255 |
| Extrusion temperature (° C.) | 305 | 305 | 305 | 305 | 305 | 305 | 305 | 305 |
| Second component | PE | PE | PE | PE | PE | PE | PE | PE |
| MFR (g/10 min) | 16 | 16 | 16 | 16 | 16 | 16 | 16 | 16 |
| Melting point (° C.) | 130 | 130 | 130 | 130 | 130 | 130 | 130 | 130 |
| Extrusion temperature (° C.) | 240 | 240 | 240 | 240 | 240 | 240 | 240 | 240 |
| Spun fineness (dtex) | 10 | 10 | 10 | 10 | 18 | 5 | 10 | 10 |
| Stretch ratio | 4 | 6 | 6 | 4 | 4.7 | 2.4 | 4 | 4 |
| Stretching temperature (° C.) | 105 | 105 | 105 | 105 | 90 | 90 | 90 | 90 |
| Stretching speed (m/min) | 60 | 60 | 60 | 60 | 100 | 100 | 60 | 60 |
| Heat treatment temperature (° C.) | 115 | 115 | 115 | 115 | 105 | 105 | 115 | 115 |
| Fineness based on corrected mass (dtex) | 2.8 | 1.9 | 2.0 | 2.6 | 5.6 | 2.8 | 2.5 | 3.0 |
| Conjugation ratio (first component/second component) | 50/50 | 50/50 | 50/50 | 50/50 | 50/50 | 50/50 | 50/50 | 50/50 |
| Strength (cN/dtex) | 2.4 | 3.1 | 3.3 | 2.4 | 3.4 | 2.4 | 3.8 | 2.3 |
| Elongation (%) | 126 | 177 | 154 | 229 | 88 | 91 | 84 | 217 |
| Degree of orientation | 4.3 | 4.4 | 5.4 | 5.1 | 6.8 | 4.5 | 7.8 | 6.6 |
| Degree of crystallinity | 21.8 | 25.3 | 24.6 | 20.3 | 18.8 | 18.6 | 21.4 | 21.4 |
| DSC peak ratio (peak 1/peak 2) | 7.01 | 3.90 | 3.21 | 2.21 | 2.17 | 4.30 | 3.06 | 1.10 |
| Basis weight ($g/m^2$) | 25 | 25 | 25 | 25 | 25 | 25 | 25 | 25 |
| Flexibility | Good | Good | Good | Good | Poor | Good | Poor | Marginal |
| Specific volume ($cm^3/g$) | 80 Good | 95 Good | 92 Good | 71 Good | 67 Marginal | 58 Poor | 75 Good | 73 Good |

From the results in Table 1, in Examples 1 to 4 related to the invention, a degree of orientation is 6.0 or less, and a degree of crystallinity is 20% or more. The nonwoven fabric prepared using the conjugate fibers of the invention gave a product having the flexibility and the bulkiness by increasing the degree of crystallinity while the degree of orientation was suppressed.

On the other hand, in the conjugate fibers in Comparative Example 2, a degree of orientation is 6.0 or less, but a degree of crystallinity is not 20% or more. Therefore, the nonwoven fabric prepared using the conjugate fibers is found to give a product having the flexibility and no bulkiness. In the conjugate fibers in Comparative Example 3, a degree of crystallinity is 20% or more, but a degree of orientation is not 6.0 or less. Therefore, the nonwoven fabric prepared using the conjugate fibers is found to give a product having improved bulkiness but poor flexibility.

INDUSTRIAL APPLICABILITY

From thermo-fusible conjugate fibers of the invention, a nonwoven fabric having high flexibility and excellent bulkiness can be prepared by increasing a degree of crystallinity in a polyester-based resin, while a degree of orientation therein is suppressed. The nonwoven fabric obtained from the thermo-fusible conjugate fibers of the invention is excellent in flexibility and bulkiness, and therefore can be utilized in an application in which both the bulkiness and the flexibility are required, for example, the application to various textile products in which the bulkiness and the flexibility are required, such as an absorbent article including a diaper, a napkin and an incontinence pad, a medical and sanitary material including a gown and a surgical gown, an indoor interior material including a wall sheet, a shoji paper and a floor material, a life-related material including a cover cloth, a cleaning wiper and a kitchen garbage cover, a toiletry product including a disposable toilet and a toilet cover, an article for pet, including a pet sheet, a diaper for pet and a towel for pet, an industrial material including a wiping material, a filter, a cushioning material, an oil adsorbent and an adsorbent for an ink tank, a general medical material, a bed clothing and a nursing article.

The invention claimed is:

1. Thermo-fusible conjugate fibers, comprising, as a first component polyethylene terephthalate, and as a second component, a high density polyethylene having a melting point lower than a melting point of the first component, wherein a volume ratio of the first component/the second component is 30/70 to 50/50, and a degree of orientation is 6.0 or less in the polyethylene terephthalate, and a degree of crystallinity therein is 20% or more therein, wherein single yarn fiber elongation is 126% to 229%.

2. The thermo-fusible conjugate fibers according to claim 1, being sheath-core conjugate fibers in which the first component is a core component and the second component is a sheath component.

3. The theinio-fusible conjugate fibers according to claim 1, wherein, in DSC measurement, a peak ratio with regard to a peak height of a maximum endothermic peak in an endothermic peak in the range of 245° C. to 250° C. to a peak height of a maximum endothermic peak in an endothermic peak in the range of 251° C. to 256° C. is 2.2 or more.

4. The thenno-fusible conjugate fibers according to claim 1, wherein single yarn fiber strength is 3.2 cN/dtex or less.

5. A sheet-shaped fiber aggregate, comprising the thermo-fusible conjugate fibers according to claim 1.

6. The sheet-shaped fiber aggregate according to claim 5, being a nonwoven fabric.

7. A method for producing theiiuo-fusible conjugate fibers, comprising:

(1) a step of obtaining unstretched sheath-core conjugate fibers by melt spinning by applying, as a core component, polyethylene terephthalate, and as a sheath component, a high density polyethylene having a melting point lower than a melting point of the polyethylene terephthalate, wherein a volume ratio of the core component/the sheath component is 30/70 to 50/50;

(2) a step of stretching the unstretched sheath-core conjugate fibers obtained in the step (1) at a temperature higher by 30° C. or more than a glass transition temperature of the polyethylene terephthalate; and (2-1) a step of drying the sheath-core conjugate fibers obtained in the step (2) in a temperature range that is lower than a melting point of the sheath component and not lower by over 15° C. than the melting point of the sheath component, wherein single yarn fiber elongation of the thermo-fusible conjugate fibers is 126% to 229%.

8. A method for producing a nonwoven fabric, comprising:

(1) a step of obtaining unstretched sheath-core conjugate fibers by melt spinning by applying, as a core component, polyethylene terephthalate, and as a sheath component, a high density polyethylene having a melting point lower than a melting point of the polyethylene terephthalate, wherein a volume ratio of the core component/the sheath component is 30/70 to 50/50;

(2) a step of stretching the unstretched sheath-core conjugate fibers obtained in the step (1) at a temperature higher by 30° C. or more than a glass transition temperature of the polyethylene terephthalate;

(2-1) a step of drying the sheath-core conjugate fibers obtained in the step (2) in a temperature range that is lower than a melting point of the sheath component and not lower by over 15° C. than the melting point of the sheath component, (3) a step of forming a fiber web by a carding method using the thermo-no-fusible conjugate fibers being the sheath-core conjugate fibers obtained in the step (2-1); and (4) a step of bonding entanglement parts of the fiber web by applying heat treatment to the fiber web obtained in the step (3) at a temperature equal to or higher than the melting point of the high density polyethylene and lower than the melting point of the polyethylene terephthalate, wherein single yarn fiber elongation of the theimo-fusible conjugate fibers is 126% to 229%.

* * * * *